US005676771A

United States Patent [19]

Yano et al.

[11] Patent Number: 5,676,771

[45] Date of Patent: Oct. 14, 1997

[54] NON-ORIENTED SILICON STEEL SHEET AND METHOD

[75] Inventors: Koji Yano; Atsuhito Honda; Takashi Obara; Minoru Takashima, all of Okayama, Japan

[73] Assignee: Kawasaki Steel Corporation, Japan

[21] Appl. No.: 711,756

[22] Filed: Sep. 5, 1996

Related U.S. Application Data

[63] Continuation of Ser. No. 309,057, Sep. 20, 1994, abandoned.

[30] Foreign Application Priority Data

Sep. 29, 1993 [JP] Japan ..... 242920
Dec. 28, 1993 [JP] Japan ..... 335648

[51] Int. Cl.[6] ..... C22C 38/06

[52] U.S. Cl. ..... 148/307; 148/112; 148/121

[58] Field of Search ..... 148/307, 112, 148/121

[56] References Cited

FOREIGN PATENT DOCUMENTS 63-137122 6/1988 Japan .

*Primary Examiner*—Sikyin Ip
*Attorney, Agent, or Firm*—Austin R. Miller

[57] ABSTRACT

A non-oriented silicon steel sheet having a low core loss contains Si in an amount of about 2.5–5.0 wt % and S restricted to about 0.003 wt % or less and inclusions; the volume ratio of those inclusions having a particle size of about 4 μm or higher to the total volume of inclusions is about 5–60%, and the volume ratio of inclusions having a particle size less than about 1 μm to the total volume of inclusions is about 1–15%; when the sheet contains Mn in an amount of about 0.4–1.5%, and the volume ratio of particles less than 1 μm is about 1–5%, the silicon steel sheet also has a low rotation core loss.

The method of manufacturing comprises controlling the change of a cooling speed to about 5° C./s$^2$ or less in the cooling process of such steel sheet in a finish annealing.

3 Claims, 8 Drawing Sheets

NON-ORIENTED SILICON STEEL SHEET AND METHOD

This application is a continuation of application Ser. No. 08/309,057, filed Sep. 20, 1994, now abandoned.

BACKGROUND OF THE INVENTION

1. Field of the Invention

The present invention relates to a silicon steel sheet having a low core loss, and further relates to a silicon steel sheet having both a low core loss and a low rotation core loss. The invention further concerns a method of manufacturing non-oriented silicon steel sheet having a low core loss and excellent low magnetic field characteristics.

2. Description of the Related Art

Non-oriented silicon steel sheets are widely used as core materials for motors, transformers and the like. Recently, the efficiency of electric appliances has needed improvement from a viewpoint of energy saving. Further, it is required to reduce core loss further.

The general concept of increasing added amounts of alloy elements such as Si, Al and the like to increase specific resistance is generally known as a way of reducing the core losses of non-oriented silicon steel sheets. However, the addition of alloy elements such as Si, Al and the like for this purpose causes problems because the cold rolling properties of the steel are harmed by the presence of the added elements. Moreover, increase of added Si and Al is disadvantageous due to increase of material cost, processing and the like.

Alternatively, reduction of core loss has been attempted by optimizing the aggregated steel structure by improving conditions during the cold rolling process. Technology of such method is disclosed in, for example, Japanese Patent Examined Publication No. Sho 56-22931 and the like.

However, further improvement of core loss by optimization of the aggregated structure is difficult because the optimum aggregated structure conditions and methods suitable for use with added Si are already available. Therefore, it is difficult to reduce core loss further by optimizing the aggregated silicon steel structure.

Further, core loss can be reduced by reducing amounts of impurities or numbers of precipitated particles in the steel. Reduction of impurities in steel is disclosed in Japanese Patent Unexamined Publication No. Sho 59-74258. Although this is effective to reduce core loss, high degrees of purification depend upon specialized iron and steel manufacturing technology; the degree of purification presently achieved has reached substantially its upper limit. Thus, it is difficult to achieve further reduction of core loss in this way.

Reduction of the number of inclusions and precipitates in the steel is disclosed in Japanese Patent Unexamined Publication No. Sho 59-74256, Japanese Patent Unexamined Publication No. Sho 60-152628 and Japanese Patent Unexamined Publication No. Hei 3-104844. Although these technologies reduce the number of inclusions and precipitations they depend upon special purification at a high level of technology. Further improvement of core loss cannot be achieved without unexpected breakthroughs in the entire iron and steel manufacturing technology.

Japanese Patent Unexamined Publication No. Sho 59-74256 describes a correlation between the number of inclusions and the core loss when the number of inclusions having a particle size of 1 μm or higher is 120 inclusions/$mm^2$ or more. The reference does not discuss any influence of inclusions when the size and number of inclusions is less.

While Japanese Patent Unexamined Publication No. Sho 60-152628 describes that the number of inclusions having a particle size of 5 μm or higher must be 80 inclusions/$mm^3$ or less to obtain the effect of final annealing, it describes nothing as to the influence of the number or size of inclusions on the core loss of the steel.

Japanese Patent Unexamined Publication No. Hei 3-104844 discloses a method of reducing the number of microscopic inclusions in a non-oriented silicon steel sheet containing Si in an amount of 0.1–2.0 wt %. There is no teaching, however, of the influence of inclusions on core loss and how to control the inclusions when applied to high quality non-oriented silicon steel sheet containing Si in an amount of 2.5–5.0 wt % and S in an amount of 0.0030 wt % or less.

Even if core loss is improved by reducing the presence of microscopic MnS having a particle size of 0.5 μm or less as in the case of this technology, many oxides remain having a particle size of 0.5 μm or higher or 5 μm or lower. Their adverse influence upon core loss cannot be avoided, and significant core loss reduction is not achieved.

Japanese Patent Unexamined Publication No. Sho 51-62115 and Japanese Patent Unexamined Publication No. Sho 55-24942 disclose prevention of precipitation of microscopic sulfides by the addition of REM (rare earth metals) and Ca for reducing microscopic inclusions (similar to Japanese Patent Unexamined Publication No. Hei 3-104884). However, Japanese Patent Unexamined Publication No. Hei 3-104884, Japanese Patent Unexamined Publication No. Sho 51-62115 and Japanese Patent Unexamined Publication No. Sho 55-24942 disclose nothing as to the influence of the numbers or sizes of inclusions on core loss.

The aforesaid references are not actually used in industry. An industrially usable core loss reducing technology for non-oriented silicon steel sheets is very much needed.

Objects of the Invention

An important object of the present invention is to provide a non-oriented silicon steel sheet having low core loss, and to provide such a sheet having both low core loss and low rotation core loss.

It is important to improve the flux density in a low magnetic field to improve the accuracy of the stopping angle of stepping motors used with motors in which a non-oriented silicon steel sheet is used. Further, transformers are sometimes required to have a high flux density in a low magnetic field. Therefore, a non-oriented silicon steel sheet is sometimes required not only to have a low core loss but also to have excellent magnetic characteristics in a low magnetic field.

Grain boundary, precipitations, lattice defects, internal stress and the like are conventionally considered as factors influencing low magnetic field characteristics. It is quantitatively known that they influence the movement of domain walls. In particular, controlling the change of cooling speed as proposed by Japanese Patent Unexamined Publication No. Sho 63-137122 and controlling cooling speed as proposed by Japanese Patent Unexamined Publication No. Sho 52-96919 have been contemplated as methods of reducing internal stress.

However, we have found that internal stress changes depend not only upon the form and distribution of precipitations but also the structures of grain boundaries and the like, even under the same external force. Although the mutual action between them and the cooling speed and changes of the cooling speed must be examined, no developments have heretofore been based on such a finding.

Accordingly, it is another important object of the present invention to provide an advantageous and novel silicon steel sheet and method of manufacturing a novel non-oriented silicon steel sheet having stably improved low magnetic field characteristics while also maintaining low core loss.

SUMMARY OF THE INVENTION

We have discovered that the inclusions and precipitations in non-oriented silicon steel sheets influence core loss differently depending upon their sizes. This has been discovered as a result of many investigations and examinations in attempts to lower the core losses of non-oriented silicon steel sheets. (Hereinafter, precipitations in the steel are sometimes referred to as inclusions). More specifically, it has been found that core loss can be greatly improved by positively reducing inclusions having specific ranges of sizes. The sizes serve as a factor in deteriorating core loss so that the amounts of sizes of the inclusions have a predetermined volume ratio or less in relation to the total volume of the inclusions, even if the total number of inclusions and the total volume of inclusions are the same as those of conventional silicon steel sheets.

The present invention, based on this discovery, has reduced the core loss of non-oriented silicon steel sheets by controlling the volume ratios of inclusions for each inclusion size range present in the steel.

The present invention provides a non-oriented silicon steel sheet having a low core loss which contains Si in an amount of about 2.5–5.0 wt % and S restricted to about 0.003 wt % or less, wherein the volume ratio of inclusions in the steel having a particle size of about 4 μm or higher to the total volume of inclusions in the steel is 5–60%, and wherein the volume ratio of the inclusion in the steel having a particle size less than about 1 μm to the total volume of inclusions in the steel is about 1–15%.

Further, the present invention has created a non-oriented silicon steel sheet having a low core loss as well as a low rotation core loss, when the steel contains Si in an amount of about 2.5–5.0 wt %, Mn in an amount of about 0.4–1.5% and S restricted to about 0.003 wt % or less, wherein the volume ratio of inclusions in the steel having a particle size of about 4 μm or higher to the total volume of inclusions in the steel is about 5–60%, and the volume ratio of inclusions in the steel having a particle size less than about 1 μm to the total volume of inclusions in the steel is about 1–5%.

We have discovered that, even if non-oriented silicon steel sheets are obtained by controlling inclusions as described above, not all of the silicon steel sheets have excellent low magnetic field characteristics.

Thus, we have discovered that the distribution of sizes of inclusions and strain in the steel cooling operation during manufacture significantly influence the low magnetic field characteristics of the steel.

The present invention makes it possible to provide a method of manufacturing a non-oriented silicon steel sheet having a low core loss together with excellent low magnetic field characteristics. The silicon steel sheet contains Si in an amount of about 2.5–5.0 wt % and S restricted to about 0.003 wt % or less. The volume ratio of the inclusions in the steel having particle sizes of about 4 μm or greater to the total volume of the inclusions in the steel is about 5–60%. The volume ratio of inclusions in the steel having a particle size less than about 1 μm to the total volume of the inclusions in the steel is about 1–15%.

The method comprises the step of controlling the change of cooling speed of the steel to about 5° C./s$^2$ or less in performing the cooling process in the finish annealing step when the non-oriented silicon steel sheet is manufactured by subjecting the silicon steel sheet to a single cold rolling process or to two or more cold rolling processes with intermediate annealing therebetween, to achieve final thickness, and subjecting the resulting cold-rolled silicon steel sheet to final annealing.

We have specifically examined in detail the relationship between the number of inclusions and the core loss by using 0.5 mm thick non-oriented silicon steel sheets containing Si in an amount of about 3.0 wt %. This was carried out by means of an optical microscope.

These investigations will be explained in connection with the drawings, wherein:

DRAWINGS

Figure 1:
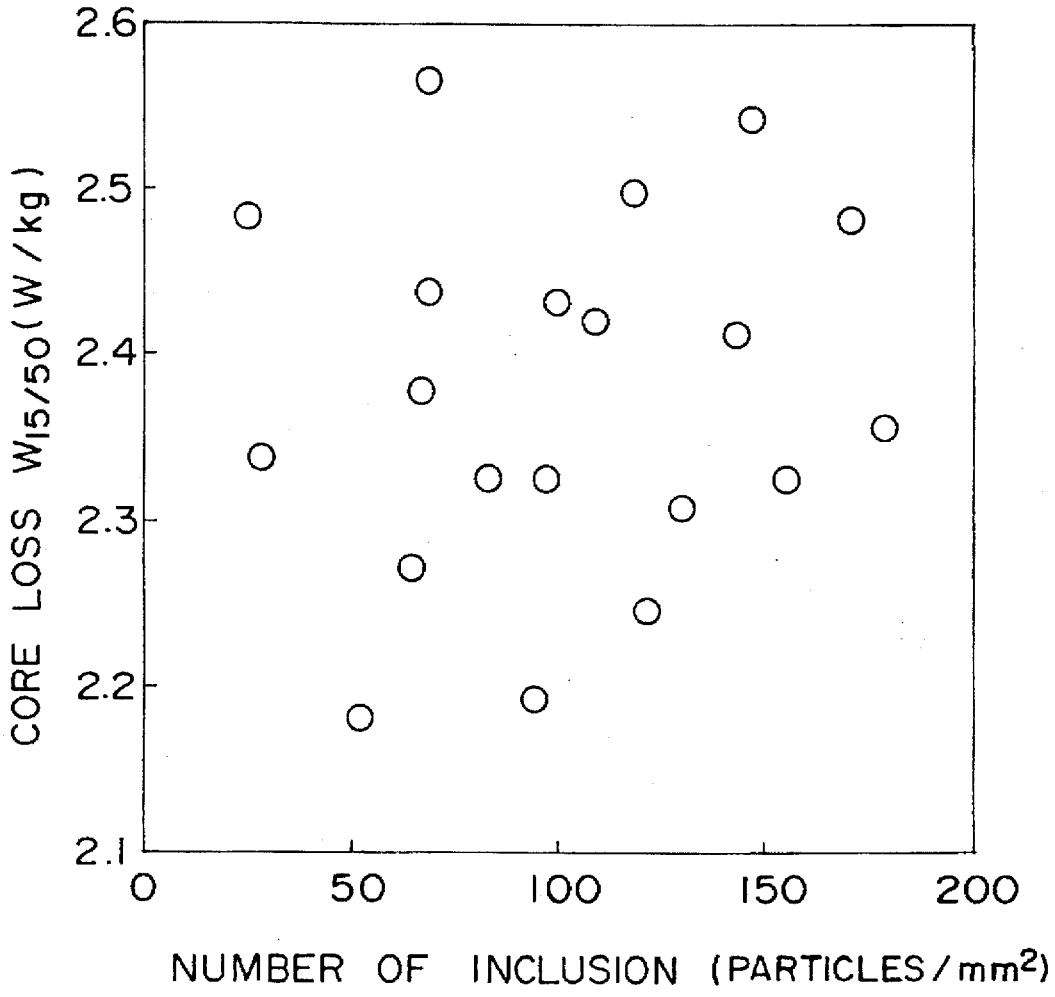
FIG. 1 is a chart showing relationship between core loss and number of inclusions.

As shown in FIG. 1, although the reduction of inclusions in ordinary steel seems to improve a core loss as an overall tendency, the relationship between the number of inclusions and the core loss which was already evaluated cannot be clearly defined.

When the components used, and the manufacturing history of non-oriented silicon steel sheets used for the investigation were examined, it was found that although S and N had about the same compositions (S: 0.0030 wt % or less, N: 0.0030 wt % or less), the manufacturing conditions varied somewhat in the processes such as steel making, hot rolling and the like, although the steel sheets were made by essentially the same processes.

Since it is contemplated that variations of manufacturing conditions such as steel making and hot rolling influenced the sizes of inclusions and changes of sizes of inclusions influenced core loss, experiments and evaluations were carried out by carefully considering the influence of the sizes of the inclusions on core loss. This investigation was carried out in such a manner that the inclusions of non-oriented silicon steel sheets each containing Si in an amount of 3.5 wt % were classified as (a) particle sizes of about 4 μm or higher, (b) about 2 μm or higher to less than about 4 μm, (c) about 1 μm or higher to less than about 2 μm, and (d) less than about 1 μm. The number of inclusions per 1 $mm^2$ in each size category was determined by an optical micrometer and the relationship between the numbers of inclusions in each size category and core loss ($W_{15/50}$) was subjected to multiple regression analysis to discover the influence of each size category of the inclusions on core loss.

Figure 2:
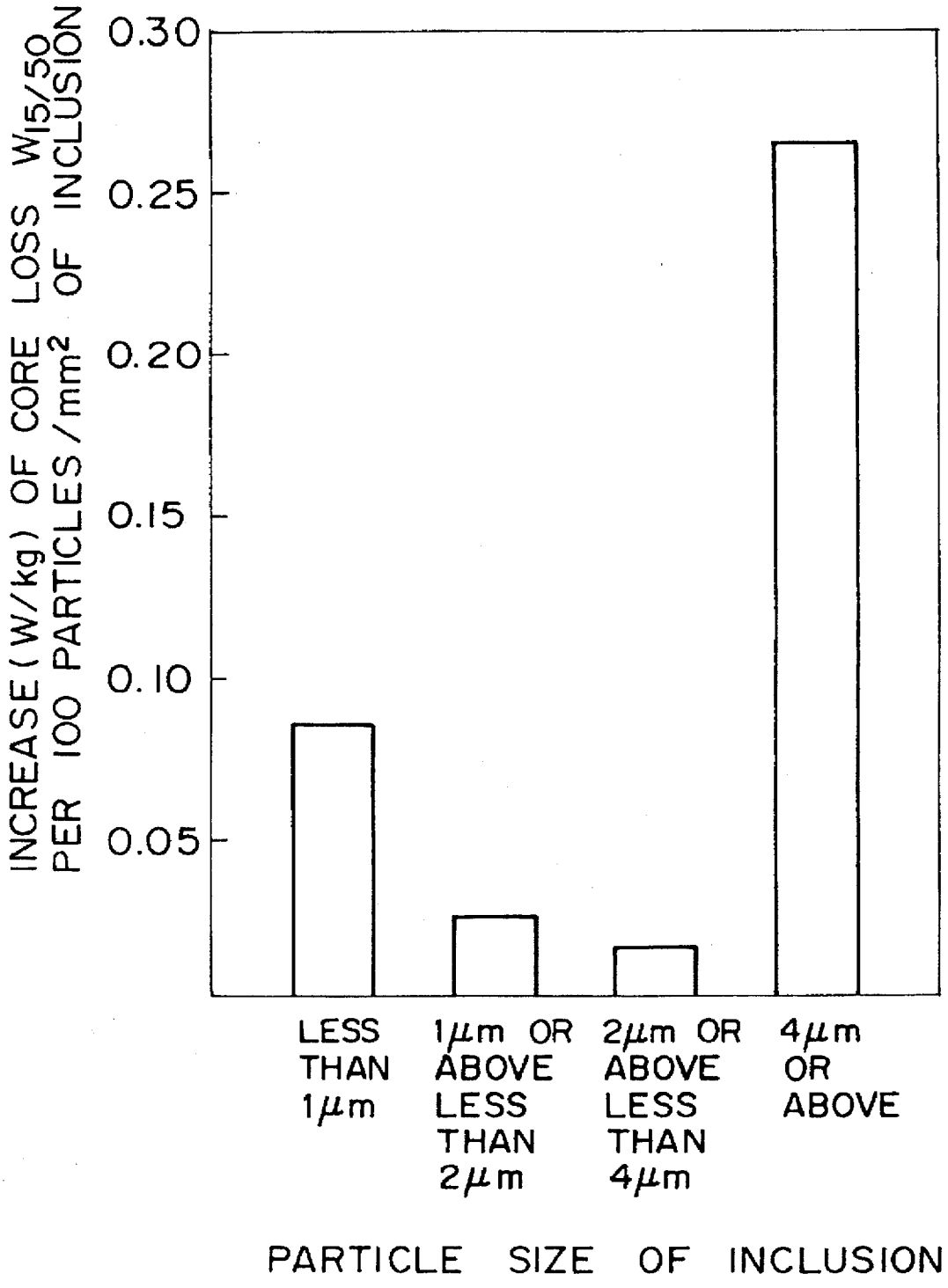
FIG. 2 is a bar graph showing the effect of inclusion particle sizes upon core loss deterioration.

FIG. 2 shows the result of this analysis. It was found that inclusions having particle sizes of about 4 μm or higher greatly increased core loss, that the particle size category less than about 1 μm and the category having particle sizes of about 2 μm or higher to less than about 4 μm, and the category about 1 μm or higher to less than about 2 μm, influenced the core loss less.

It is contemplated that one reason why the inclusions having particle sizes of about 4 μm or higher more greatly influenced the core loss is that such inclusions caused crystal grains in undesirable directions in the recrystallization process from the viewpoint of magnetic characteristics. Further, it is assumed that one reason why the category less than about 1 μm influenced the core loss less is that the inclusions had a greater effect in preventing movement of domain walls, which directly influenced core loss, than the category of the inclusions of about 1 μm or higher. This has been a highly useful discovery in the creation of this invention.

Figure 3:
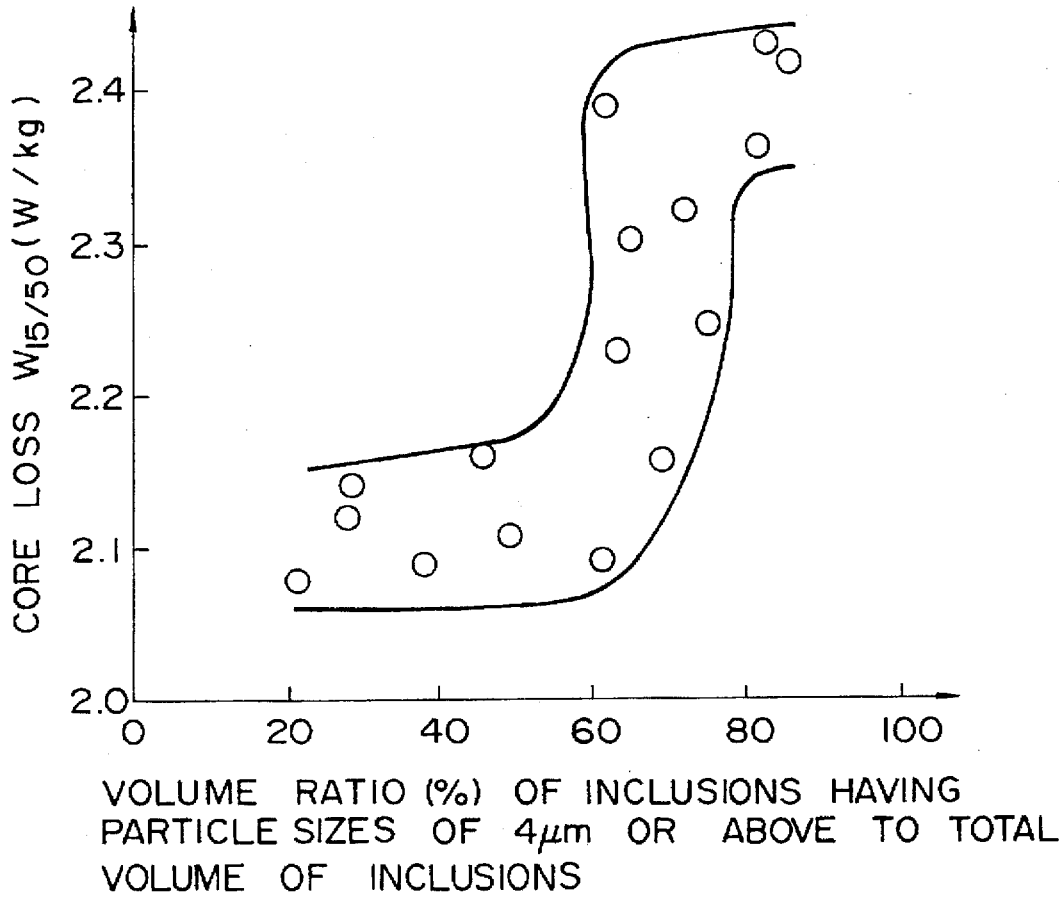
FIG. 3 is a chart relating core loss with the volume ratio of inclusions having sizes of about 4 μm to total inclusions.

The relationship between (a) volume ratio of inclusions having particle sizes of about 4 μm or higher to the total volume of inclusions and (b) core loss was investigated means of an optical microscope. FIG. 3 shows the results of the investigation.

As is apparent from FIG. 3, when the volume ratio of inclusions having particle sizes of about 4 μm or higher to the total volume of inclusions exceeds about 60%, the core loss value ($W_{15/50}$) is remarkably increased (deteriorated).

Figure 4:
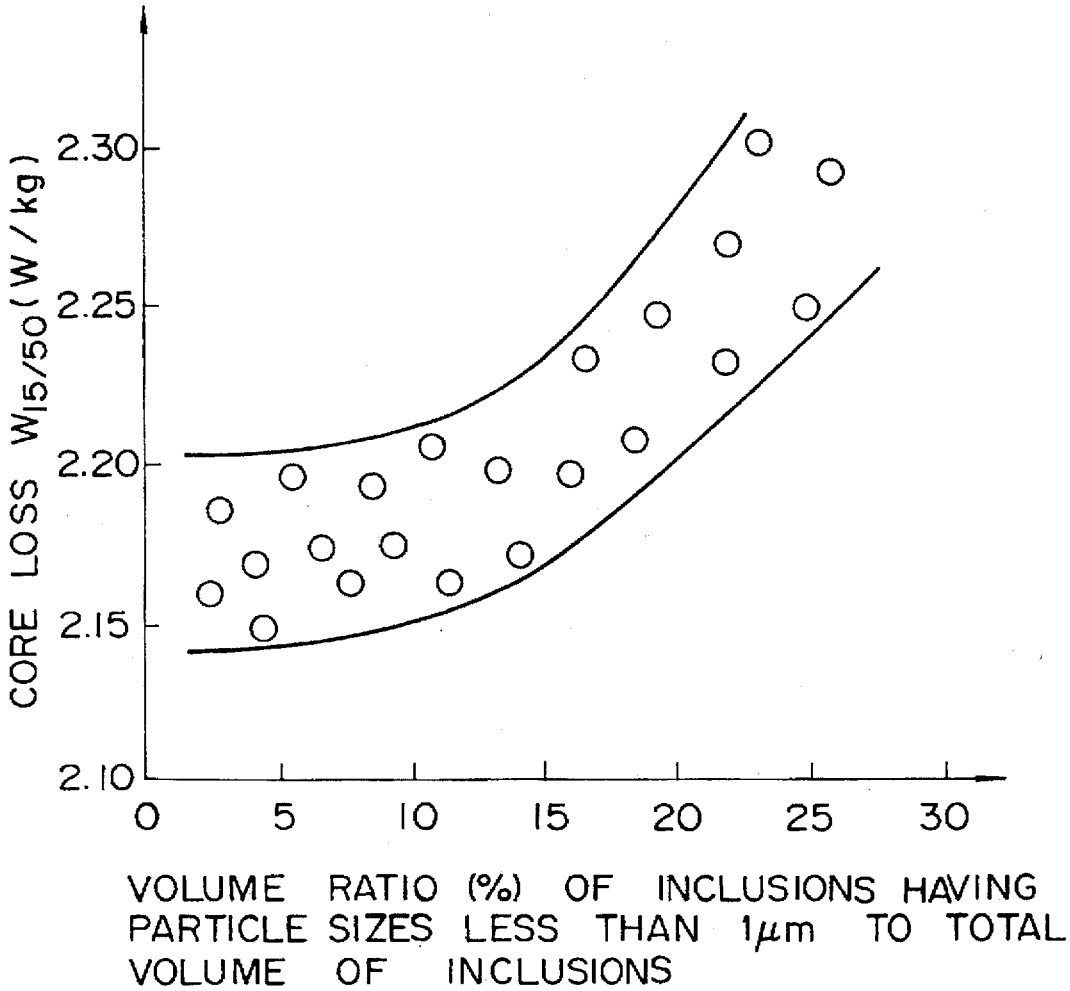
FIG. 4 is a chart similar to FIG. 3, relating core loss to volume ratio of inclusions having particle sizes less than about 1 μm to total inclusions.

With respect to steel sheets in which the volume ratio of inclusions having particle sizes of about 4 μm or higher was about 50% or less of the total volume of inclusions, the relationship between volume ratio of the inclusions having particle sizes less than about 1 μm and the core loss was investigated. The investigation was carried out by an electron microscope. FIG. 4 shows the results of the investigation.

Although the deterioration of core loss caused by inclusions having particle sizes of about 4 μm or higher appears in FIG. 3 but does not clearly appear in FIG. 4, we have further discovered that when the volume ratio of inclusions having particles sizes less than about 1 μm exceeds about 15%, the core loss value ($W_{15/50}$) will be deteriorated (increase).

Accordingly, it is factually established that the volume ratio of inclusions having particle sizes of about 4 μm or higher must be about 60% or less, and that the volume ratio of inclusions having particle sizes less than about 1 μm must be about 15% or less.

We have further newly found that the rotation core loss which was known to be caused at the T-junction of the core of a three-phase transformer, and the teeth backward portion of the core of a rotating machine, could be reduced by more strongly controlling the volume ratio of inclusions classified as to sizes.

Figure 5:
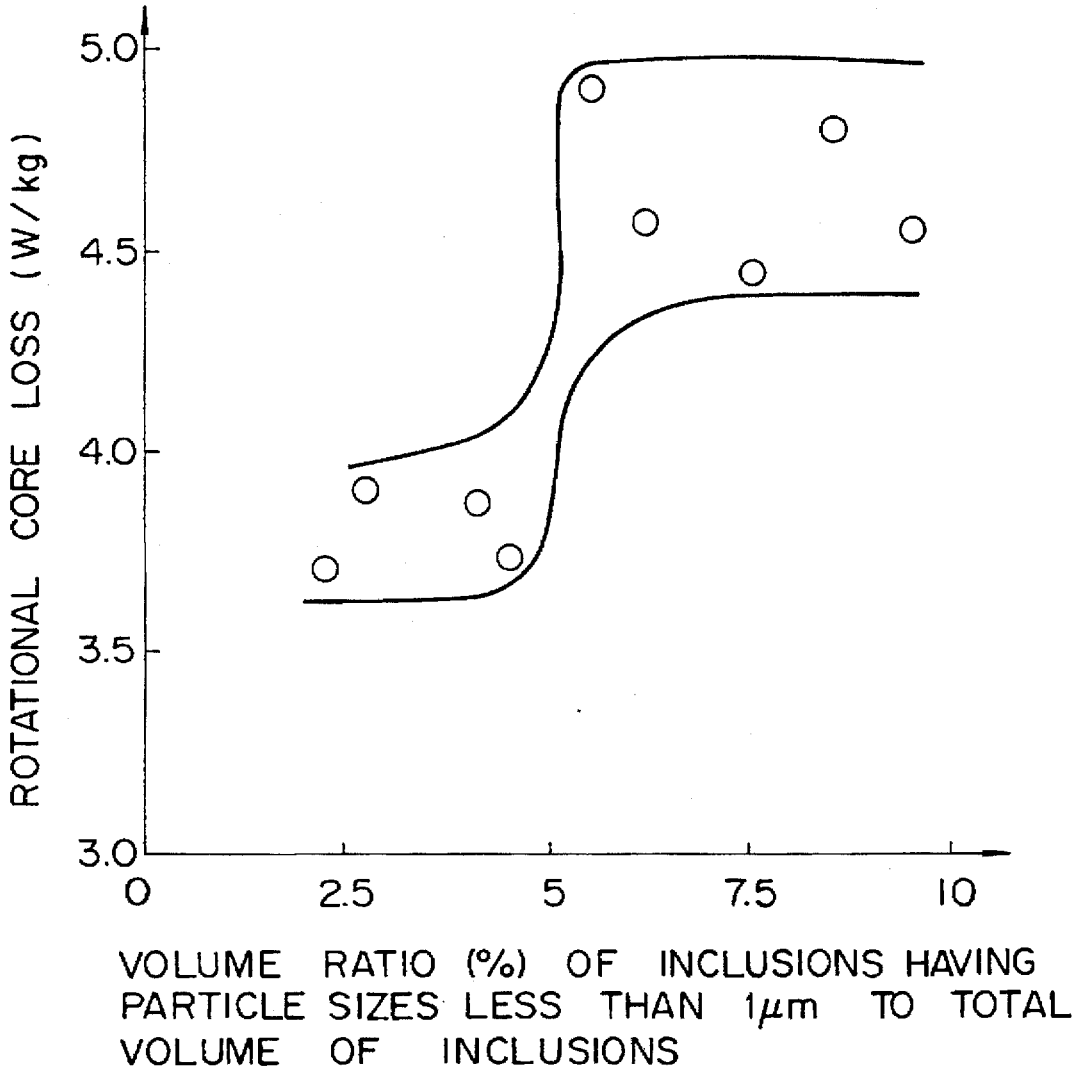
FIG. 5 is a chart similar to FIG. 4, showing the relationship between rotational core loss and volume ratio.

We have closely investigated the relationship between the volume ratio (%) of inclusions having particle sizes less than about 1 μm to the total volume of the inclusions and compared those volume ratios with the rotation core losses (W/kg) with respect to the specimens used in FIG. 4. FIG. 5 shows the results of those examinations. As is apparent from FIG. 5, when the volume ratio (%) of the inclusions having particle sizes less than about 1 μm exceeds about 5%, the rotation core loss rapidly deteriorates (increases). It is accordingly important to lower rotation core loss by reducing the volume ratio of inclusions having particle sizes less than about 1 μm to about 5% or less.

When FIG. 4 is compared with FIG. 5, it will be realized that inclusions having particle sizes less than about 1 μm have greater influence on rotation core loss than on core loss ($W_{15/50}$), and that the number of inclusions having particle sizes less than about 1 μm must be further reduced to lower rotation core loss.

Figure 6:
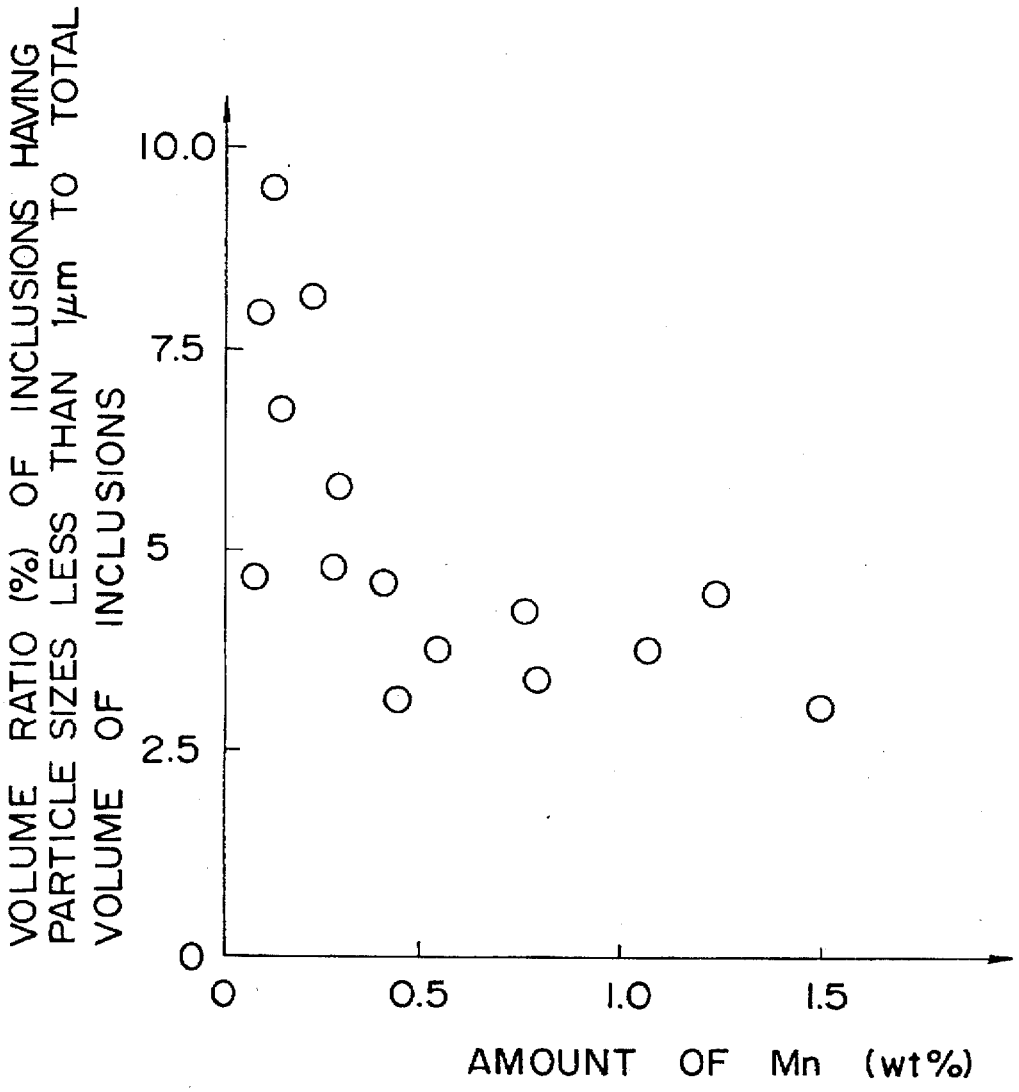
FIG. 6 is a chart relating the amount of Mn present in the steel and volume ratio of inclusions less than about 1 μm.

It has been discovered to be advantageous to add Mn to the steel in an amount of about 0.4 to 1.5 wt % to reduce the percentage of inclusions having particle sizes less than about 1 μm. As is apparent from FIG. 6 showing the relationship between the amount of Mn present in the steel and the volume ratio of inclusions having particle sizes less than about 1 μm to the total volume of the inclusions, it is advantageous to add Mn in an amount of about 0.4 wt % to reduce the percentage of inclusions having particle sizes less than about 1 μm. If the Mn is added in an amount of about 1.5 wt % or more, rotation core loss deteriorates (increases) for reasons other than the inclusions. The novel step of regulating the amount of Mn to about 0.4–1.5 wt % has been found to reduce the amount of solid S during hot rolling and to restrict precipitation of solid solution S as fine particulate precipitations on completion of hot rolling.

Magnetic characteristics were investigated by a 25 cm Epstein method in the aforesaid experiment. At the time, characteristics were compared by taking into account the influence caused by strain of the specimens, which is not conventionally taken into consideration.

The rotation core loss was determined by measuring the quantity of heat generated by the specimens due to the loss, i.e., the increase of temperature of the specimens by means of a thermistor.

Further, the amount of inclusions present was measured by observing the cross sections of steel sheets in their thickness direction. An optical microscope or an electron microscope may be used for this observation. Magnification should be ×400 or less in the case of the former and ×400–×1000 in the case of the latter.

Test pieces were made (controlling them so that grinding flaws and rust were prevented) and tested (measurements of area, and the like) based on JIS G 0555 (Microscopic Test Method of Non-metallic Inclusion in Steel). According to the measurement method, the number and sizes of the inclusions were measured by image analysis instead of counting the number of grid points occupied by inclusions.

The sizes and volume of the inclusions were calculated from the values of circle diameters which were determined from observed images so that the areas of the inclusion had the same area. The result obtained by the measurement accurately represents the average characteristics of the specimens because the distribution of the inclusions is essentially isotropic.

This method enabled observation and measurement of inclusions less than 1 μm in size without technical problems, overcoming difficulty of measurement by optical microscope or electron microscope of low magnification. Measurements of inclusions as in the present invention indicate all the non-ferrous inclusions in the steel, including precipitates such as sulfides, AlN and the like.

The present invention creates a novel non-oriented silicon steel sheet having a low core loss by positively controlling the sizes of the inclusions in the steel, and by positively controlling the volume ratio of the inclusions for each size range. The present invention can stably achieve a significantly reduced core loss even as compared to existing core loss reduction methods according to prior art, which are realized by simple reduction of the total amount of impurities and reduction of the amount of inclusions even if the amounts of S and N are on the same level.

The volume ratio of the inclusions in steel having particle sizes of about 4 μm or higher to the total volume of the inclusions is controlled to about 60% or less and the volume ratio of inclusions having particle sizes less than about 1 μm or less to the total volume of the inclusions in the steel is controlled to about 15% or less.

When the volume ratio of the inclusions in the steel, having particle sizes of about 4 μm or higher to the total volume of the inclusions, exceeds about 60% in the steel, an aggregated structure is formed with respect to magnetic characteristics, and the core loss is rapidly increased. Thus the volume ratio of inclusions of 4 μm or higher in the steel is controlled to about 60% or less.

Basically, the amount of the inclusions in the steel having a particle size of about 4 μm or higher is preferable to be as small as possible. Since the practically available lowest volume ratio which we obtained on the basis of the present steelmaking technology was about 5%, we restricted the lowest volume ratio to 5%. Further, when the volume ratio of inclusions in the steel having particle sizes less than about 1 μm to the total volume of inclusions in the steel exceeds about 15%, the core loss is also increased (deteriorated), thus the volume ratio of the inclusions less than about 1 μm in the steel is controlled to about 15% or less.

Further, basically, there are no lowest limit also for the volume ratio of the inclusions of less than 1 μm, however, since the value which we obtained as a practically possible lowest volume ratio available by the present steelmaking technology was about 1%, we restricted the lowest volume ratio to 1%.

Further, the preferred ratio of inclusions less than about 1 μm in the steel is controlled to about 5% or less to avoid deterioration (increase) of rotation core loss.

Although simple reduction of the volume ratio of inclusions could be achieved only by reducing the amounts of impurity elements such as the amounts of N, S and O in steel, when the amounts of N, S, O in the steel are immoderately reduced without any index, energy is uselessly consumed and the low core loss achieved by the present invention cannot reliably be achieved. Therefore, even a good core loss level were to be achieved accidentally by random reductions of the amounts of N, S, O in the steel, commercial success would be most difficult to achieve industrially achieve without the use of the method of the present invention.

On the other hand, the present invention regulates S to an amount of about 0.0030 wt % or less.

This is because although S and N form sulfides and nitrides serving as nuclei of coarse inclusions, respectively, S specifically has a much stronger tendency to do so.

Figure 7:
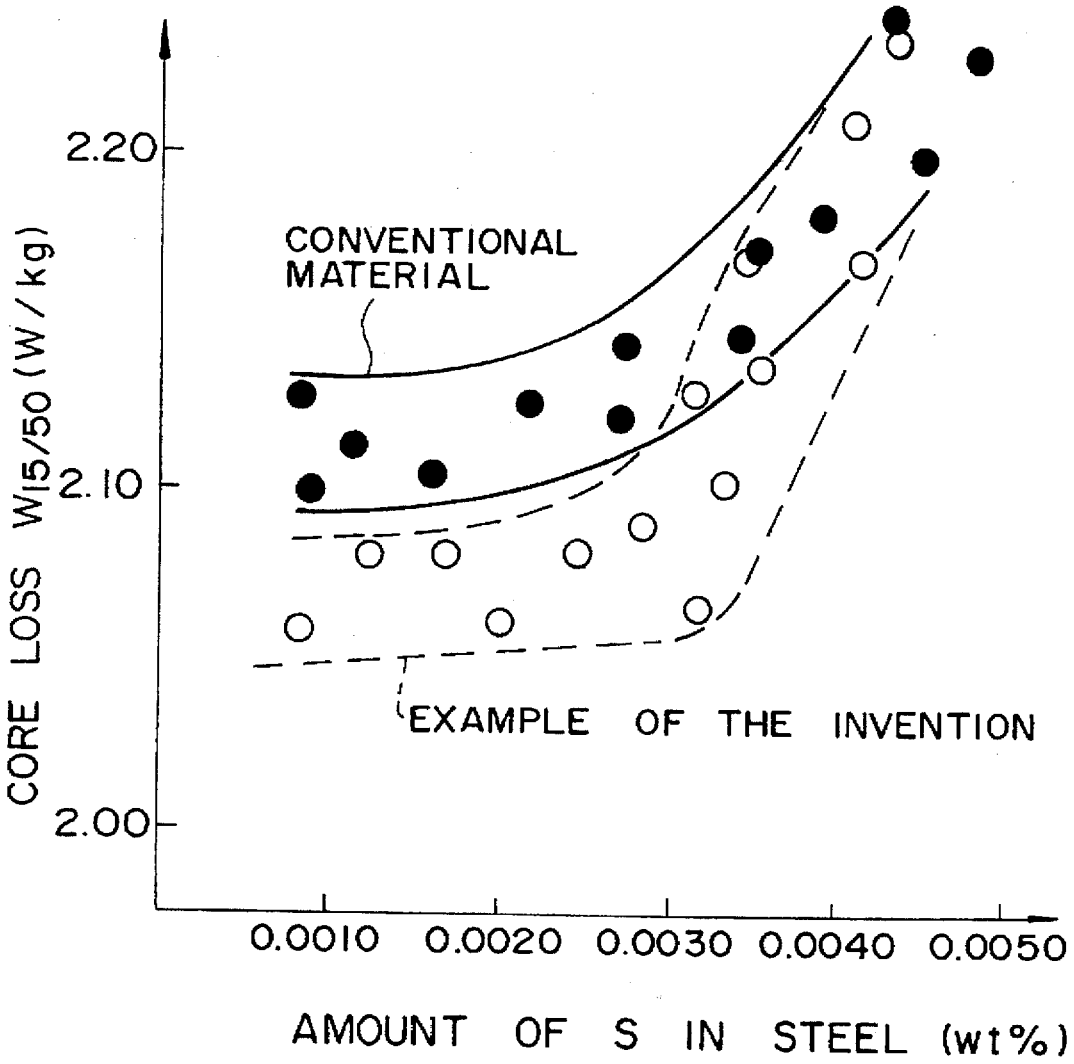
FIG. 7 is a chart relating amount of S present in the steel and core loss.

FIG. 7 shows the result of our investigations of the influence of S on core loss when an amount of S was varied in specimens containing inclusions within the range of the present invention, and also in specimens of conventional materials containing inclusions, these specimens being composed of non-oriented silicon steel sheets containing Si in an amount of 3.8 wt %. In FIG. 7 it is factually shown that when the amount of S is less than about 0.0030 wt %, good core loss characteristics can be obtained. Thus, the amount of S in steel is preferably regulated to 0.0030 wt % or less.

A silicon steel sheet to which the present invention is applied generally contains Si in an amount of about 2.5–5.0 wt %. Since Si is a component which is useful to reduce core loss by increasing resistivity, the lower Si limit for lowering core loss is regulated to about 2.5 wt % and the upper limit is regulated to about 5.0 wt % or less. If the upper limit exceeds about 5 wt %, cold-rolling properties tend to be harmed.

Typical ranges of other components of the steel are as follows.

C: about 0.01 wt % or less.

Since C is a harmful component from the viewpoint of magnetic characteristics, it is preferable that its content is as low as possible; thus C is regulated to about 0.01 wt % or less.

Mn: about 0.1–1.5 wt %

Since addition of Mn is effective to reduce the amount of solid solution S when a slab is heated, it is added to restrict hot brittleness caused by the presence of S. When the added amount of Mn is less than about 0.1 wt % the effect of the addition is not significant, whereas when the amount exceeds about 1.5 wt %, magnetic characteristics deteriorate. Thus, Mn is added in the range of about 0.1–1.5 wt %.

When the rotation core loss of the steel is to be lowered in addition to reduction of core loss, Mn must be added in an amount of about 0.4 wt % or more to further reduce the presence of inclusions having particle sizes less than about 1 μm.

Al: about 2.0 wt % or less

Al is a component useful not only to effectively contribute to deoxidation of steel and reduction of the amount of AlN precipitation, but also to improve core loss by increasing resistivity, working in about the same way as Si. When the amount of Al exceeds about 2.0 wt %, however, cold rolling properties deteriorate. Thus, Al is added in the range of about 2.0 wt % or less.

P: about 0.005–0.15 wt %

Although P is effective to improve core loss, when its added amount is less than about 0.005 wt %, it does not act effectively, whereas when its added amount exceeds about 0.15 wt %, cold rolling properties are greatly reduced. Thus, P is preferably added in the range of about 0.005–0.15 wt %.

Sb, Sn, Cu, Ni etc. may be added in addition to the above.

Non-oriented silicon steel sheets as an object of the present invention can be made by controlling the sizes of inclusions in the steel and the volume ratios of the inclusions for each size. More specifically, molten steel having been refined and degassed is formed into a slab by continuous casting or casting-blooming rolling. Desulfurization flux using Ca or the like, or a desulfurizing agent using both REM (rare earth element): containing Ce in an amount of about 50 wt %) and the desulfurization flux may be used in desulfurization processing. The slab may be hot rolled in the usual way.

The slab may be heated after it has been cooled once and hot rolled or it may be hot rolled without being cooled after it has been subjected to casting or blooming rolling.

The sizes and volume ratios of the inclusions in the steel are controlled by regulation of components, by desulfurization and by hot rolling.

Reduction of S and N in steel, extension of degassing time, and desulfurization can be used as means for restricting the volume ratios of the inclusions having particle sizes of about 4 μm or higher to the total volume of inclusions to about 60% or less. Reduction of the inclusions of this size can be achieved by reducing sulfides and nitrides serving as nuclei of coarse inclusions by reducing quantities of S and N in the steel.

Further, lowering of the slab heating temperature, increasing the amount of Mn in the steel for the purpose of reduction of solid solution S and reduction of mixed substances such as refractory material and the like (Zr etc.) are included as means for restricting the volume ratio of the inclusions having a particle size of about 1 μm or lower in steel to the total inclusion volume to 15% or less. Restriction of the solid solution precipitation of inclusions when a slab is heated and the like is more effective than reduction of S, N in steel to reduce the inclusions of this size.

The cold rolling process may be any one of the types in which the thickness of the product is achieved by cold rolling once, or in which the thickness of the product is attained by carrying out cold rolling twice with intermediate annealing, and in which a hot rolled sheet is annealed and then the thickness of the product is attained by cold-rolling once. Thereafter, the cold-rolled sheet is formed into the product by final finish annealing.

DETAILED DESCRIPTION OF PREFERRED EXAMPLES

(Example 1)

Molten steel was refined in a converter, degassed and an alloy component added to make a target amount of Si: 2.6 wt %, Al; 0.10 wt %, and Mn: less than 0.2 wt % while regulating the content of S to various values, and was then continuously cast. Slabs were made by intensifying a desulfurization process, a deoxidation process and a degas process at the time. The slabs were heated at a temperature of 1100°–1200° C. and hot rolled into coils having a thickness of 2.0 mm. The hot-rolled sheets were cleaned with acid and continuously annealed at 950° C. for 30 seconds and cold rolled to a final thickness of 0.5 mm. Thereafter, the cold-rolled sheets were subjected to finish annealing at 890° C. for 20 seconds and a volume ratio control of inclusions for each size. Table 1 shows the result of measurement of the magnetic characteristics of conventional steel sheets having the same component and the steel sheets subjected to the volume ratio inclusion control for each size, and further shows the result of measurement of the volume ratio of the inclusions for each size. The magnetic characteristics were determined by the 25 cm Epstein method and the volume ratio of the inclusions for each size was measured with an optical microscope. As is apparent from Table 1, the steel sheets whose inclusion volume ratio was within the range of the present invention had core loss values ($W_{15/50}$) that were significantly superior to those of the conventional steel sheets.

TABLE 1

| Steel No. | Amount of S (wt %) | Desulfurization processing | Volume Ratio of Inclusion for Each Size: Less than 1 μm | Volume Ratio of Inclusion for Each Size: 4 μm or higher | Core Loss $W_{15/50}$ (W/kg) | Classification |
|---|---|---|---|---|---|---|
| 1 | 0.0028 | REM + Flux | 12.5% | 58.7% | 2.81 | Example of the Invention |
| 2 | 0.0020 | REM + Flux | 7.8% | 43.4% | 2.80 | Example of the Invention |
| 3 | 0.0006 | Flux | 3.8% | 32.2% | 2.75 | Example of the Invention |
| 4 | 0.0003 | Flux | 1.3% | 16.2% | 2.73% | Example of the Invention |
| 5 | 0.0002 | Flux | 1.0% | 5.0% | 2.71% | Example of the Invention |
| 6 | 0.0045 | Flux | 15.4% | 77.0% | 3.11 | Comparative Example |
| 7 | 0.0008 | REM + Flux | 17.5% | 48.6% | 3.01 | Comparative Example |
| 8 | 0.0013 | REM + Flux | 10.9% | 63.1% | 2.95 | Comparative Example |

(Example 2)

Molten steel was refined in a converter, degassed and an alloy component added to make a target amount of Si: 3.8 wt %, Al; 0.8 wt %, and Mn: 0.2 wt % while regulating the content of S to various values and then continuously cast. Slabs were made by intensifying a desulfurization process, a deoxidation process and a degas process at the time. The slabs were heated at a heating temperature of 1050°–1200° C. and hot rolled to coils having a thickness of 2.0 mm. The hot-rolled sheets were cleaned with acid and continuously annealed at 1050° C. for 30 seconds and cold rolled to a final thickness of 0.5 mm. Thereafter, the cold-rolled sheets were subjected to finish annealing at 1050° C. for 30 seconds and a volume ratio control of inclusion sizes. Table 2 shows the magnetic characteristics of the thus obtained steel sheets and conventional steel sheets having the same components, and further the result of measurement of the volume ratios of inclusions for each size. The magnetic characteristics of the steels were investigated by the 25 cm Epstein method and the volume ratio of the inclusions for each size was measured with an optical microscope. As is apparent from Table 2, the steel sheets whose volume ratios of inclusions was in the range of the present invention had core loss values ($W_{15/50}$) which were significantly superior to those of the conventional steel sheets.

TABLE 2

| Steel No. | Amount of S (wt %) | Desulfurization processing | Volume Ratio of Inclusion for Each Size: Less than 1 μm | Volume Ratio of Inclusion for Each Size: 4 μm or higher | Core Loss $W_{15/50}$ (W/kg) | Classification |
|---|---|---|---|---|---|---|
| 9 | 0.0027 | REM + Flux | 14.1% | 57.9% | 2.09 | Example of the Invention |
| 10 | 0.0015 | REM + Flux | 7.8% | 45.6% | 2.08 | Example of the Invention |
| 11 | 0.0008 | REM + Flux | 4.2% | 39.8% | 2.05 | Example of the Invention |
| 12 | 0.002 | Flux | 1.4% | 7.2% | 2.03 | Example of the Invention |
| 13 | 0.0037 | Flux | 17.7% | 66.9% | 2.20 | Comparative Example |
| 14 | 0.0020 | REM + Flux | 15.6% | 49.0% | 2.15 | Comparative Example |
| 15 | 0.0009 | REM + Flux | 8.0% | 62.4% | 2.17 | Comparative Example |

(Example 3)

Molten steel was refined in a converter, degassed and an alloy component added to make a target amount of Si: 2.7 wt %, Al; 0.1 wt %, and Mn: 0.4 wt % while regulating the content of S to various values, and then continuously cast. Slabs were made by intensifying a desulfurization process, a deoxidation process and a degas process at the time. The slabs were heated at a heating temperature of 1100°–1200° C. and hot rolled to coils having a thickness of 2.0 mm. The hot-rolled sheets were cleaned with acid and continuously annealed at 950° C. for 30 seconds and cold rolled to a final thickness of 0.5 mm. Thereafter, the cold-rolled sheets were subjected to finish annealing at 890° C. for 20 seconds and with a volume ratio control of inclusion for each size. Table 3 shows the results of measurement of the magnetic characteristics of the sheets and the rotation core losses of the same steel sheets, and comparing these characteristics with those of conventional steel sheets having the same components, and further the results of measurements of volume ratios of inclusions for each size. The magnetic characteristics were investigated by the 25 cm Epstein method, the rotation core loss was determined by the temperature increase method and the volume ratio of inclusions for each size was measured with an electron microscope. As is apparent from Table 3, the steel sheets whose volume ratios of inclusions was within the range of the present invention had a rotation core loss value ($W_{15/50}$) that was significantly superior to those of the conventional steel sheets.

TABLE 3

| Steel No. | Amount of S (wt %) | Volume Ratio of Inclusion for Each Size: Less than 1 μm | Volume Ratio of Inclusion for Each Size: 4 μm or higher | Core Loss $W_{15/50}$ (W/kg) | Rotation Core Loss (W/kg) | |
|---|---|---|---|---|---|---|
| 16 | 0.0029 | 4.7% | 57.0% | 2.79 | 4.8 | Example of the Invention |
| 17 | 0.0018 | 5.8% | 62.3% | 2.99 | 5.9 | Comparative Example |
| 18 | 0.0006 | 3.1% | 58.9% | 2.74 | 4.9 | Example of the Invention |
| 19 | 0.0039 | 1.7% | 56.4% | 2.97 | 5.8 | Comparative Example |
| 20 | 0.0024 | 4.4% | 72.7% | 2.97 | 5.8 | Comparative Example |
| 21 | 0.0010 | 6.2% | 57.6% | 2.80 | 5.5 | Comparative Example |

(Example 4)

Molten steel was refined in a converter, degassed and an alloy component added with a target amount of Si: 3.5 wt %, Al; 1.0 wt %, and Mn: 0.5 wt % while regulating the content of S to various values, and then continuously cast. Slabs were made by intensifying a desulfurization process, a deoxidation process and a degas process at the time. The slabs were heated at a temperature of 1100°–1200° C. and hot rolled to form coils having a thickness of 2.0 mm. The hot-rolled sheets were cleaned with acid and continuously annealed at 1050° C. for 30 seconds and cold rolled to a final thickness of 0.5 mm. Thereafter, the cold-rolled sheets were subjected to finish annealing at 1050° C. for 30 seconds and with volume ratio control of inclusions for each size. Table 4 shows the results of measurement of the magnetic characteristics and the rotation core loss of the thus obtained steel sheets and comparative examples show conventional steel sheets having the same components. Table 4 further shows the results of measurements of the volume ratios of inclusions for each size. The magnetic characteristics were investigated by a 25 cm Epstein method, the rotation core loss was determined by the temperature increase method and the volume ratio of inclusions for each size was measured with an electron microscope. As is apparent from Table 4, the steel sheets whose volume ratios of inclusions are within the range of the present invention have rotation core loss values that are significantly superior to those of conventional steel sheets.

TABLE 4

| Steel No. | Amount of M (wt %) | Amount of S | Volume Ratio of Inclusion for Each Size: Less than 1 μm | Volume Ratio of Inclusion for Each Size: 4 μm or higher | Core Loss $W_{15/50}$ (W/kg) | Rotation Core Loss (W/kg) | Classification |
|---|---|---|---|---|---|---|---|
| 22 | 0.5 | 0.0028 | 4.7% | 57.6% | 2.08 | 3.7 | Example of the Invention |
| 23 | 0.5 | 0.0017 | 7.6% | 70.2% | 2.17 | 4.7 | Comparative Example |
| 24 | 0.5 | 0.0008 | 4.6% | 40.8% | 2.07 | 3.6 | Example of the Invention |
| 25 | 0.5 | 0.0035 | 4.3% | 58.2% | 2.18 | 4.9 | Comparative Example |
| 26 | 0.5 | 0.0017 | 3.0% | 62.5% | 2.18 | 4.9 | Comparative Example |
| 27 | 0.5 | 0.0009 | 6.0% | 39.7% | 2.09 | 4.6 | Comparative Example |
| 28 | 0.3 | 0.0024 | 6.1% | 58.4% | 2.09 | 4.7 | Comparative Example |
| 29 | 0.4 | 0.0021 | 4.6% | 57.9% | 2.08 | 3.8 | Example of the Invention |

Next, non-oriented silicon steel sheets were made in such a manner that hot rolled sheets containing Si in an amount of 3.5 wt % were finished to a thickness of 0.50 mm by a single cold roll processing and the cold-rolled sheets were subjected to finish annealing at 1000° C. for 30 seconds and cooled by variously changing the cooling speed in the range of 1°–20° C./second$^2$ up to the cooling speed of 30° C./second so as to obtain electromagnetic steel sheets excellent in low magnetic field characteristics of the aforesaid electromagnetic steel sheets having the low core loss.

Figure 8:
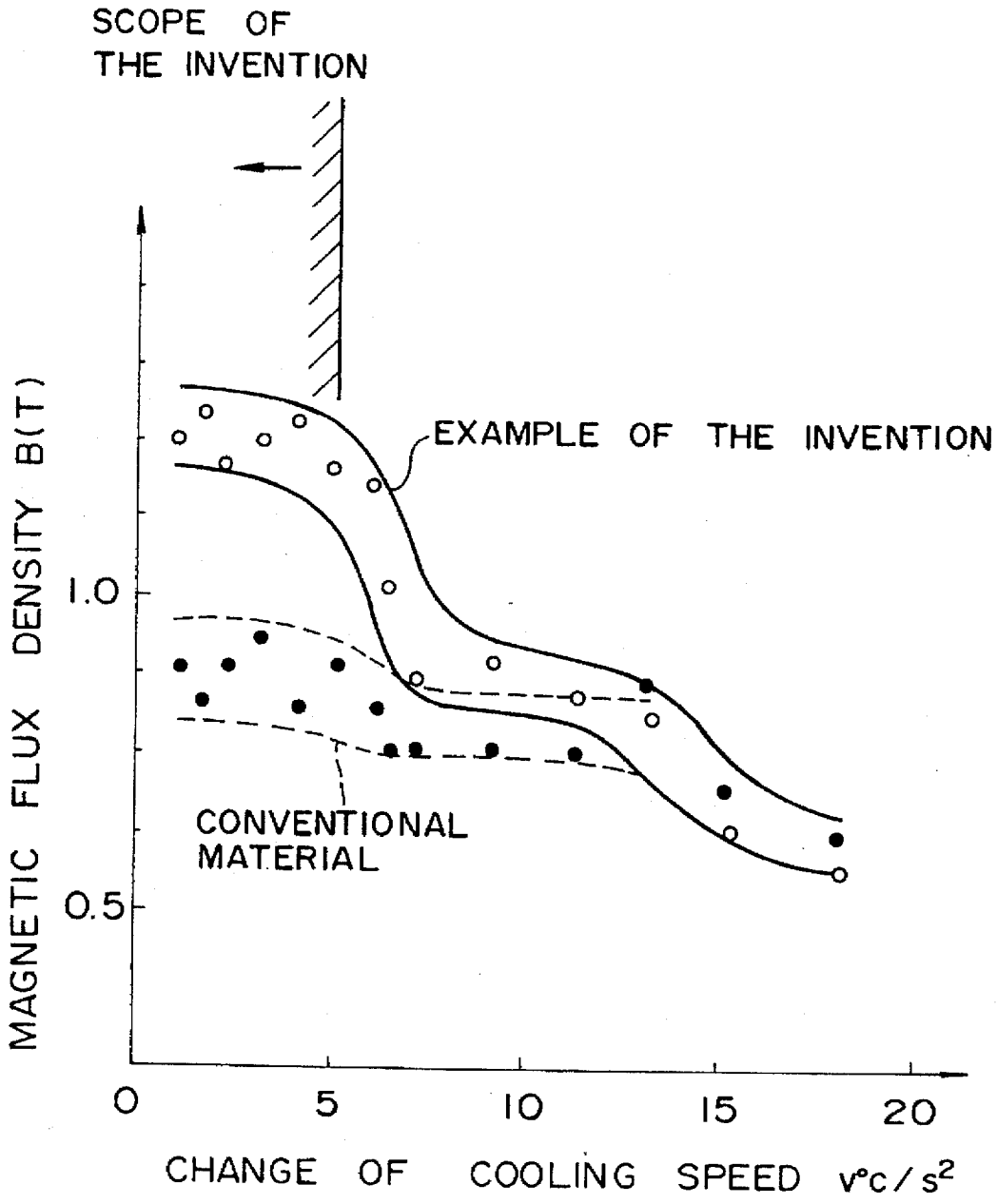
FIG. 8 is a chart relating magnetic flux density and change of cooling speed.

FIG. 8 of the drawings shows the results of the influence of the obtained non-oriented silicon steel sheets on low magnetic field characteristics represented by the distribution of the sizes of the inclusions and the changes of cooling speeds in finish annealing. In FIG. 8, the black dot symbols ● represent an example of the distribution of the sizes of conventional inclusions (the inclusions having particle sizes less than about 1 μm occupy 25% of the total inclusion) and open-circle symbols ○ represent examples of distribution of sizes of inclusions according to the present invention. As is apparent from FIG. 8, excellent low magnetic field characteristics $B_1$ are achieved only when the distribution of the sizes of the inclusions is in the range of the present invention, and the change of cooling speed in finish annealing is about 5° C./second$^2$ or less.

Although the mechanism of such a phenomenon is not fully known, it is contemplated that since remaining internal stress can be reduced as low as possible by controlling the distribution of sizes of the inclusions to the range of the present invention, the low magnetic field characteristics are caused to be significantly improved.

Although it suffices only to carry out the above annealing process at 800°–1100° C. for 0–120 seconds by ordinary methods to manufacture an electromagnetic steel sheet that is excellent in low magnetic field characteristics of the aforesaid electromagnetic steel sheets having low core loss, it is essential that cooling be executed after the soaking of finish annealing is carried out by changing the cooling speed at about 5° C./second$^2$ or less. When the change of cooling speed exceeds about 5° C./second$^2$, there is no significant improvement for low magnetic field characteristics.

An example of the change of cooling speed is to change the cooling speed, which is to be carried out at a given speed in the range of about 5–50° C./second, at about 5° C./second$^2$ or less until a predetermined cooling speed is achieved. In the present invention, however, superior low magnetic field characteristics can be achieved when the change of cooling speed satisfies the range of the present invention regardless of the cooling speed pattern from soaking temperature to ambient temperature. Although it suffices only to control the change of the cooling speed in the range from soaking temperature to 600° C., needless to say, the control is preferably carried out up to an ordinary temperature.

(Example 5)

Molten steel was refined in a converter, degassed and alloy component added to make a target amount of Si: 2.6 wt %, Al; 0.1 wt %, and Mn: less than 0.2 wt % while regulating the level of S to various values, and then continuously cast. Slabs were made by intensifying a desulfurization process, a deoxidation process and a degas process at the time. The slabs were heated to 1100°–1200° C. and then hot rolled to form coils having a thickness of 2.0 mm. The hot-rolled sheets were cleaned with acid and continuously annealed at 950° C. for 30 seconds and cold rolled to a final thickness of 0.5 mm. Thereafter, the cold-rolled sheets were soaked at 890° for 20 seconds together with conventional steel sheets and subjected to finish annealing by changing the cooling speed up to 30° C./second. The magnetic characteristics and the sizes and volume ratios of the inclusions of the thus obtained product were investigated. The magnetic characteristics were investigated by a 25 cm Epstein method and the size and volume ratios of the inclusions were measured with an optical microscope. Table 5 shows the results of the measurements.

TABLE 5

| Steel No. | Amount of S (wt %) | Desulfurization Processing | Change of Cooling Speed (°C./s²) | Volume Ratio of Inclusion for Each Size: Less than 1 μm | Volume Ratio of Inclusion for Each Size: 4 μm or higher | Core Loss $W_{15/50}$ (W/kg) | Flux Density B1 (T) | Classification |
|---|---|---|---|---|---|---|---|---|
| 30 | 0.0028 | REM + Flux | 3 | 12.5% | 58.7% | 2.81 | 1.2 | Example of the Invention |
| 31 | 0.0028 | REM + Flux | 10 | 12.5% | 58.7% | 2.78 | 0.9 | Comparative Example |
| 32 | 0.0020 | REM + Flux | 3 | 7.8% | 43.4% | 2.80 | 1.1 | Example of the Invention |
| 33 | 0.0020 | REM + Flux | 5 | 7.8% | 43.4% | 2.85 | 1.2 | Example of the Invention |
| 34 | 0.0045 | Flux | 3 | 15.4% | 77.0% | 3.11 | 0.9 | Comparative Example |
| 35 | 0.0045 | Flux | 10 | 15.4% | 77.0% | 3.15 | 0.8 | Comparative Example |

As is apparent from Table 5, the steel sheets whose volume ratios of inclusions and changes of cooling speed are in the range of the present invention have a core loss value ($W_{15/50}$) and $B_1$ which are superior to those of conventional steel sheets.

(Example 6)

Molten steel was refined in a converter, degassed and an alloy component added with a target amount of Si: 3.8 wt %, Al; 0.8 wt %, and Mn: 0.2 wt % while regulating the level of S to various values, and then continuously cast. Slabs were made by intensifying a desulfurization process, a deoxidation process and a degas process at the time. The slabs were heated at a temperature of 1100°–1200° C. and then hot rolled to form coils having a thickness of 2.0 mm. The hot-rolled sheets were cleaned with acid and continuously annealed at 1050° C. for 30 seconds and cold rolled to a final thickness of 0.5 mm. Thereafter, the cold-rolled sheets were soaked at 1050° for 30 seconds together with conventional steel sheets and subjected to finish annealing by changing cooling speeds up to 30° C./second Table 6 shows the results of the measurements.

TABLE 6

| Steel No. | Amount of S (wt %) | Desulfurization Processing | Change of Cooling Speed (°C./s²) | Volume Ratio of Inclusion for Each Size: Less than 1 μm | Volume Ratio of Inclusion for Each Size: 4 μm or higher | Core Loss $W_{15/50}$ (W/kg) | Flux Density B1 (T) | Classification |
|---|---|---|---|---|---|---|---|---|
| 36 | 0.0027 | REM + Flux | 3 | 14.1% | 57.9% | 2.09 | 1.2 | Example of the Invention |
| 37 | 0.0027 | REM + Flux | 5 | 14.1% | 57.9% | 2.10 | 1.3 | Example of the Invention |
| 38 | 0.0015 | REM + Flux | 3 | 7.8% | 45.6% | 2.08 | 1.1 | Example of the Invention |
| 39 | 0.0015 | REM + Flux | 5 | 7.8% | 45.6% | 2.07 | 1.2 | Example of the Invention |
| 40 | 0.0015 | REM + Flux | 10 | 7.8% | 45.6% | 2.06 | 0.8 | Comparative Example |
| 41 | 0.0008 | Flux | 3 | 4.2% | 39.8% | 2.05 | 1.1 | Example of the Invention |
| 42 | 0.0008 | Flux | 10 | 4.2% | 39.8% | 2.07 | 0.8 | Comparative Example |
| 43 | 0.0037 | Flux | 3 | 17.7% | 66.9% | 2.20 | 0.9 | Comparative Example |
| 44 | 0.0037 | Flux | 10 | 17.7% | 66.9% | 2.19 | 0.8 | Comparative Example |
| 45 | 0.0009 | REM + Flux | 3 | 8.0% | 62.4% | 2.17 | 0.9 | Comparative Example |
| 46 | 0.0009 | REM + Flux | 10 | 8.0% | 62.4% | 2.18 | 0.8 | Comparative Example |

According to the present invention, both the core loss of a non-oriented silicon steel sheet and its rotation core loss can be significantly lowered.

In addition, according to the present invention, the core loss of a non-oriented silicon steel sheet can be lowered and excellent low magnetic field characteristics obtained.

What is claimed is:

1. A silicon steel sheet of a non-oriented grade having a low core loss, said sheet containing particulate inclusions of various sizes;

said sheet also containing Si in an amount of about 2.5–5.0 wt %, Mn in an amount of about 0.1–1.5 wt %, and P in an amount of about 0.005–0.15 wt %, said sheet containing S restricted to about 0.003 wt % or less, C restricted to about 0.01 wt % or less, and Al restricted to about 2.0 wt % or less, said particulate inclusions in said steel including inclusions having particle sizes of about 4 μm or larger which are present in a volume ratio to the total volume of said particulate inclusions in said steel of about 5–60%, and said particulate inclusions in said steel also including inclusions having particle sizes that are smaller than about 1 μm which are present in a volume ratio to the total volume of said particulate inclusions in said steel of about 1–15%, said volume ratios being effective to limit core loss deterioration in said silicon steel sheet arising from the presence of said particulate inclusions of various sizes.

2. A silicon steel sheet of a non-oriented grade having both a low core loss and a low rotation core loss, said sheet comprising Si in an amount of about 2.5–5.0 wt %, Mn in an amount of about 0.4–1.5%, P in an amount of about 0.005–0.15 wt %, C restricted to about 0.01 wt % or less, Al restricted to about 2.0 wt % or less, and S restricted to about 0.003 wt % or less, and said sheet also containing a plurality of particulate inclusions of various sizes, some of which cause core loss deterioration, said particulate inclusions in said steel including inclusions having particle sizes of about 4 μm or larger which are present in a volume ratio to the total volume of said particulate inclusions in said steel of about 5–60%, and said particulate inclusions in said steel also including inclusions having particle sizes that are smaller than about 1 μm which are present in a volume ratio to the total volume of said particulate inclusions in said steel of about 1–5%, said volume ratios being effective to limit core loss and rotation core loss deterioration in said silicon steel sheet arising from said particulate inclusions of various sizes.

3. A method of manufacturing a silicon steel sheet of a non-oriented grade having favorable core loss and magnetic field characteristics, said silicon steel sheet comprising:

Si in an amount of about 2.5–5.0 wt %, and Mn in an amount of about 0.1–1.5 wt %, and P in an amount of about 0.005–0.15 wt %;

S restricted to about 0.003 wt % or less., C restricted to about 0.01 wt % or less, and Al restricted to about 2.0 wt % or less;

said sheet having a plurality of particulate inclusions of various sizes, said particulate inclusions in said steel including inclusions having particle sizes of about 4 μm or larger which are present in a volume ratio to the total volume of said inclusions in said steel of about 5–60%, and said particulate inclusions in said steel also including inclusions having particle sizes that are smaller than about 1 μm which are present in a volume ratio to the total volume of said particulate inclusions in said steel of about 1–15%, comprising the steps of:

forming a silicon steel slab, hot rolling said silicon steel slab to form a hot-rolled steel sheet, cold rolling said hot-rolled steel sheet at least once, with intermediate annealing being performed between consecutive cold rollings, to form a cold-rolled sheet, finish annealing said cold-rolled sheet to form said silicon steel sheet of a non-oriented grade, said finish annealing comprising heating said cold-rolled sheet and thereafter cooling said cold-rolled sheet, said cooling being conducted such that the change in cooling speed is about 5° C./s$^2$ or less, said volume ratios being effective to limit core loss deterioration in said silicon steel sheet arising from the presence of said particulate inclusions of various sizes.

* * * * *